US010301875B2

(12) United States Patent
Stout

(10) Patent No.: US 10,301,875 B2
(45) Date of Patent: May 28, 2019

(54) LADDER STABILIZATION APPARATUS AND METHOD OF USE

(71) Applicant: Joseph F. Stout, Sparks, NV (US)

(72) Inventor: Joseph F. Stout, Sparks, NV (US)

( * ) Notice: Subject to any disclaimer, the term of this patent is extended or adjusted under 35 U.S.C. 154(b) by 113 days.

(21) Appl. No.: 15/731,700

(22) Filed: Jul. 19, 2017

(65) Prior Publication Data

US 2019/0024457 A1 Jan. 24, 2019

(51) Int. Cl.

| | |
|---|---|
| ***E06C 1/34*** | (2006.01) |
| ***E06C 7/00*** | (2006.01) |
| ***E06C 7/48*** | (2006.01) |
| ***E06C 1/20*** | (2006.01) |
| ***E06C 7/42*** | (2006.01) |

(52) U.S. Cl.

CPC ..... *E06C 7/48* (2013.01); *E06C 1/20* (2013.01); *E06C 1/34* (2013.01); *E06C 7/42* (2013.01); *E06C 7/00* (2013.01)

(58) Field of Classification Search

CPC ... E06C 1/20; E06C 1/34; E06C 1/345; E06C 1/36; E06C 7/00; E06C 7/42; E06C 7/48; E06C 7/484; E06C 7/486; E06C 7/488

USPC ..... 182/107

See application file for complete search history.

(56) References Cited

U.S. PATENT DOCUMENTS 4,924,971 A * 5/1990 Rice ..... E06C 1/34 182/107
6,009,974 A * 1/2000 Jones ..... E06C 7/48 182/107
6,427,803 B1 * 8/2002 Moore ..... E06C 7/48 182/107
6,805,221 B1 * 10/2004 Lee ..... E06C 1/34 182/107
10,138,681 B2 * 11/2018 Crawford ..... E06C 7/188
2001/0047906 A1 * 12/2001 Murray ..... E06C 1/34 182/214
2003/0188924 A1 * 10/2003 Bamber ..... E06C 7/188 182/107
2004/0055820 A1 * 3/2004 Charlton ..... E06C 1/34 182/107
2009/0266646 A1 * 10/2009 Hamann ..... E06C 7/188 182/107
2010/0038171 A1 * 2/2010 Larard ..... E06C 7/486 182/107
2010/0170748 A1 * 7/2010 Robichaud ..... E06C 1/345 182/107
2014/0131532 A1 * 5/2014 Elmore ..... E06C 7/48 248/201
2015/0259982 A1 * 9/2015 Maragliano ..... E06C 7/505 182/107

FOREIGN PATENT DOCUMENTS

DE 4142750 A1 * 7/1992 ..... E06C 1/34

* cited by examiner

*Primary Examiner* — Joshua E Rodden

(57) ABSTRACT

The present invention is a universal stabilization apparatus which is functional for use with any type of extension ladder and can be easily manually attached/detached using only one hand of the worker. The apparatus is of simple construction, lightweight, portable, completely adjustable and attachable onto substantially any type of roof edge. The apparatus consists of only two elongated resilient members in combination and each have attachments thereon for securing the extension ladder when in use.

3 Claims, 3 Drawing Sheets

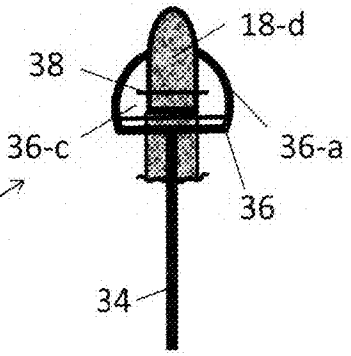
FIG. 3
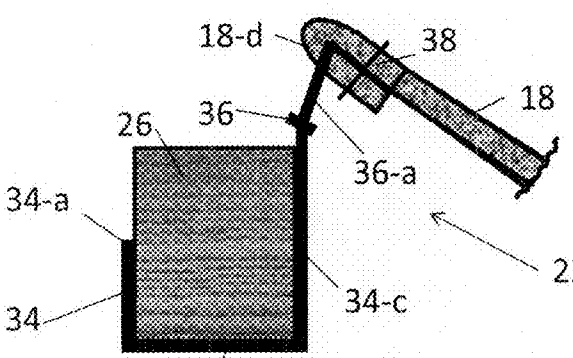
FIG. 2
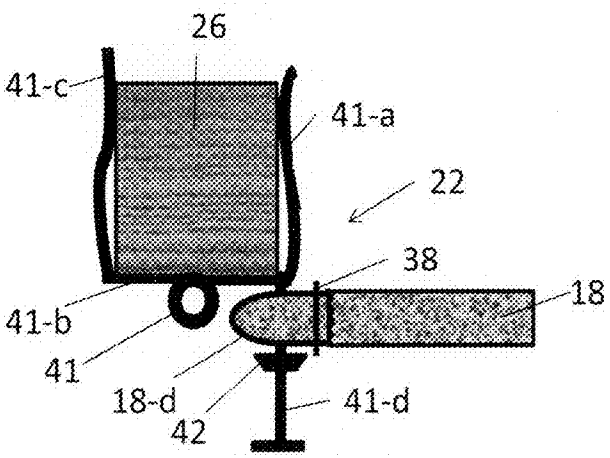
FIG. 4-B
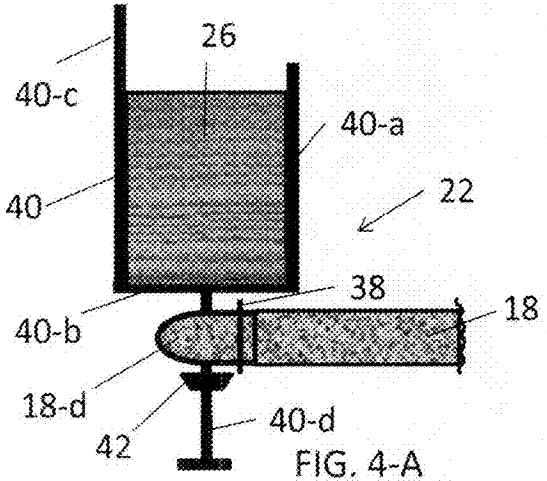
FIG. 4-A

20

LADDER STABILIZATION APPARATUS AND METHOD OF USE

FIELD OF THE INVENTION

The present invention relates in general to a means for stabilizing a ladder onto the external edge of a roof associated with a building. More particularly the invention pertains to a universal stabilization apparatus which is functional for use with any extension ladder and can be easily manually attached/detached using only one hand of the worker allowing the worker to maintain three points of contact with the ladder. The apparatus is of simple construction, lightweight, portable, completely adjustable and attachable onto substantially any type of roof edge.

BACKGROND OF THE INVENTION

It is well known that ladder related injuries are extremely common. In the U.S. alone it is estimated that 81% of fall injuries treated in emergency room departments involve a ladder. Falls remain a leading cause of unintentional injury [deaths] nationwide, and 43 percent of fatal falls in the last decade have involved a ladder. The majority of ladder related accidents are not due to ladder construction but more often are caused from the ladder not being securely stabilized while being used by the worker. Thus, it is most evident that there is a great need to provide an improved means to stabilize a ladder onto a support surface when in use.

Within the known prior art there have been numerous attempts to provide improved ladder stabilizing means. For example, U.S. Pat. No. 6,805,221 teaches a ladder positioning system. However the system is very complex and requires eyehooks to be installed onto the ladder and into the roof edge. This is very time-consuming, thus the user is discouraged and most likely will decide to take their chances and not use the system. Furthermore, the system damages the roof edge, requires tools to install, demands the installer to use both hands thus having only two points of contact, is not cost-effective and is simply not efficient or feasible for use.

Another example of prior art is taught in U.S. Pat. No. 6,427,803 wherein the ladder device includes multiple brackets, attachment plates, attachment arms, etc., each of which must be assembled during use and attached with multiple screws and/or bolts. Again this apparatus is simply much too time-consuming, damages the roof, discourages use by the consumer and is simply inefficient.

A further prior art reference is exemplified in U.S. Pat. No. 7,380,640 wherein disclosed is a securing device which requires multiple chains, clamps, plates, etc. The device is again simply much too complicated, requires both hands for installation, is bulky, difficult to adjust and is certainly not user friendly.

Other prior art references include U.S. Pat. Nos. 3,903,991, 5,165,501, 8,839,908 and 9,010,490. Each of which relate to a type of ladder stabilization means. However, each are much too complicated, require both hands for installation, must be installed using tools, are not user friendly and are simply inefficient.

SUMMARY OF THE INVENTION

The present invention recognizes addresses and resolves the inherent disadvantages associated within the known prior art in a manner heretofore not taught or conceived. The present invention has been made simpler without loss of capability. The present invention requires very few parts and is usable with substantially any type of support surface associated with a roof edge. Also, the apparatus is completely adjustable, tools are not required for installation, is lightweight, portable and user friendly. Furthermore, the user can attach, adjust and remove the apparatus with use of only one hand. This is a very important factor as this allows the user to hold on to the ladder with one hand while attaching/removing the apparatus. It is to be noted, nowhere within the known prior art is this one-handed advantage recognized, suggested or implied.

OBJECTS OF THE INVENTION

It is therefore a primary object of the present invention to provide a new ladder stabilization apparatus that is easily attached or removed using only one hand without the need for any tools. The apparatus is completely adjustable, multifunctional, of simple construction, lightweight and portable.

A further object of the present invention is to provide a new ladder stabilization apparatus that when not in use is easily attached onto the ladder for storage until needed at a later time or can easily fit into the pocket of an ordinary tool belt.

Yet another object of the present invention is to provide a new ladder stabilization apparatus that is useable with substantially any type of pre-existing extension ladder without any need for modification.

Still a further object of the present invention is to provide a new ladder stabilization apparatus that is cost effective to produce, manufacture, easily marketed and easily sold.

Other objects and advantages will become apparent when taken into consideration with the following specification and drawings.

BRIEF DESCRIPTION OF THE DRAWINGS

FIG. 2 is substantially a side view illustrating a first embodiment for a second attachment means when attached onto a support member such as a wooden beam or the eve of a roof.

FIG. 3 is substantially a front view of the second attachment means depicted in FIG. 2 when not attached onto the wooden beam or the eve of the roof.

FIG. 4-A is substantially a side view illustrating a second embodiment for a second attachment means when attached onto a support member such as a wooden beam.

FIG. 4-B is substantially a side view illustrating a third embodiment for a second attachment means when attached onto a support member such as a wooden beam.

DETAILED DESCRIPTION OF THE DRAWINGS

Figure 1:
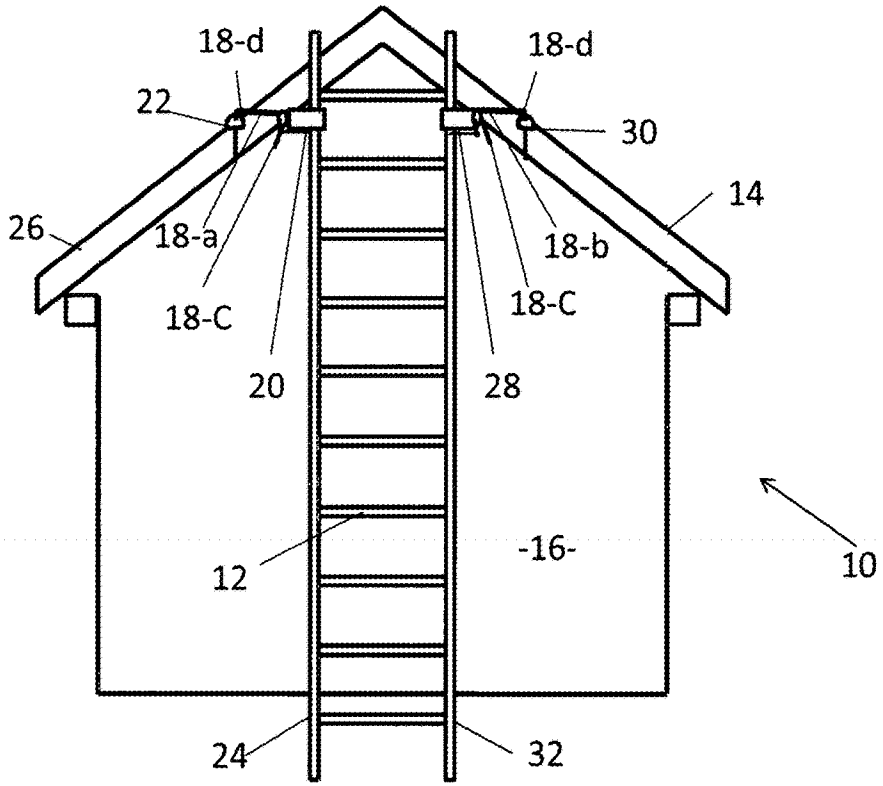
FIG. 1 is substantially a plan view for present invention depicting an extension ladder when stabilized against a roof edge associated with a building structure.

Referring now in detail to the drawings wherein like characters refer to like elements throughout the various views. As illustrated in FIG. 1, (10) represents an overview for the ladder stabilization apparatus of the present invention. Wherein depicted is a pre-existing extension ladder (12) which is positioned and stabilized against an edge of a support member (26) of a roof structure (14) associated with a pre-existing building (16). It is to be understood any type of pre-existing extension ladder (12) having first and second opposed ladder rails can be utilized with the present invention. Thus the present invention is not limited to use with any specific brand of extension ladder.

The ladder stabilization apparatus (10) including in combination of the following: A first resilient stretchable elongated member (18-*a*) and a second resilient stretchable elongated member (18-*b*). It is to be noted any type of resilient stretchable elongated member of engineering choice may be utilized, for instance a standard bungee-chord material or the like is most efficient. The first resilient stretchable elongated member (18-*a*) has a first end (18-*c*) and a second end (18-*d*). The first end (18-*c*) is fixedly attached onto a first attachment means (20) and the second end (18-*d*) is fixedly attached onto a second attachment means (22). The first attachment (20) means being adjustably removeably attachable onto a first ladder rail (24) associated with the pre-existing extension ladder (12). The second attachment means (22) being removeably slideably attachable onto a support member (26) associated with the roof structure (14).

The second resilient stretchable elongated member (18-*b*) has a first end (18-*c*) and a second end (18-*d*). The second resilient stretchable elongated member (18-*b*) includes the first end thereof (18-*c*) being fixedly attached onto a third attachment means (28) and the second end thereof (18-*d*) being fixedly attached onto a fourth attachment means (30). The third attachment means (28) being adjustably removeably attachable onto a second ladder rail (32) associated with the pre-existing extension ladder (12). The fourth attachment means (30) being removeably slideably attachable onto the support member (26) associated with the roof structure (14).

Referring now to FIGS. 2 & 3 wherein depicted is a first embodiment for the second and fourth attachment means (22 & 30). It is to be noted being both attachment means (22 & 30) are identical in shape and form, only the second attachment means (22) is depicted for illustrative purposes but it is to be understood there are two (22 & 30) as illustrated in FIG. 1. It is to be understood any suitable type of attachment means of engineering choice may be utilized. Thus, the attachment means as described herein is only exemplary and the invention is not to be limited thereto. The first embodiment for the second attachment means (22) includes substantially an integrally formed bracket (34) which is shaped to form a first upwardly protruding short leg (34-*a*), an integrally formed horizontal base (34-*b*) and an integrally formed upwardly protruding long leg (34-*c*) respectively. The upwardly protruding long leg (34-*c*) includes pivot means (36) thereon. It is to be noted the bracket (34) is of a shape and size to be slideably engaged upwardly onto the support member (26). Also, the support member (26) can be any type of support member including but not limited to, the frieze board, fascia board, gable edge, soffit, etc. It is to be further noted any suitable type of pivot means of engineering choice can be utilized. Therefore the pivot means as described herein is only exemplary and the invention is not limited thereto. The pivot means (36) is preferably slightly angled outwardly for function. The pivot means (36) includes a partial circular section (36-*a*) which forms a hollow opening (36-*c*). The hollow opening (36-*c*) allows for the second end (18-*d*) of the first resilient stretchable elongated member (18-*a*) to be thread ably inserted into and throughout thereof. Thereafter the second end (18-*d*) is folded back upon itself and fixedly attached in place by a suitable type of clip (38) or the like. Whereby, the second attachment means (22) is pivot ably attached onto the second end (18-*d*) of the first resilient stretchable elongated member (18-*a*) and the fourth attachment means (30) is pivot ably attached onto the second end (18-*d*) of the second resilient stretchable elongated member (18-*b*).

Referring now to FIG. 4-A wherein depicted is a second embodiment for the second and fourth attachment means (22 & 30). The second embodiment for the second attachment means (22) and (30) includes substantially an integrally formed bracket (40). It is to be noted the bracket (40) is of a shape and size to be slideably engaged upwardly onto the support member (26). Bracket (40) is shaped to form a first upwardly protruding short leg (40-*a*), an integrally formed horizontal base (40-*b*), an integrally formed upwardly protruding long leg (40-*c*) and a downwardly projecting leg (40-*d*), respectively. The downwardly projecting leg (40-*d*) provides pivot means thereon. It is to be again noted any suitable type of pivot means of engineering choice can be utilized. Therefore the pivot means as described herein is only exemplary and the invention is not limited thereto. The pivot means includes an outwardly projecting stop member (42) positioned distally from the integrally formed horizontal base (40-*b*) and is attached onto the midsection of the downwardly projecting leg (40-*d*). Thus creating pivot point around a partial section of the downwardly projecting leg (40-*d*) between the outwardly projecting stop member (42) and the integrally formed horizontal base (40-*b*). The partial section allows for the second end (18-*d*) of the first resilient stretchable elongated member (18-*a*) to be wrapped around thereabout and folded upon itself and fixedly attached in place by a suitable type of clip (38) or the like. Whereby, the second end (18-*d*) of the first resilient stretchable elongated member (18-*a*) can pivot or swivel around the partial section of the downwardly projecting leg (40-*d*).

Referring now to FIG. 4-B wherein depicted is a third embodiment for the second and fourth attachment means (22 & 30). The third embodiment for the second attachment means (22) and (30) includes substantially an integrally formed helical torsion spring (41). It is to be noted the helical torsion spring (41) is of a shape and size to be slideably engaged upwardly onto the support member (26). This embodiment is advantageous for use with variable sizes of support members as the helical torsion spring (41) can flex slightly and adjust to fit onto the support member (26). The helical torsion spring (41) is shaped to form a first upwardly protruding short leg (41-*a*), an integrally formed horizontal base (41-*b*), an integrally formed upwardly protruding long leg (41-*c*) and the upwardly protruding short leg (41-*a*) is interconnected onto a downwardly projecting leg (41-*d*), respectively. The downwardly projecting leg (41-*d*) provides pivot means thereon. It is to be again noted any suitable type of pivot means of engineering choice can be utilized. Therefore the pivot means as described herein is only exemplary and the invention is not to be limited thereto. The pivot means includes an outwardly projecting stop member (42) positioned distally from the integrally formed horizontal base (41-*b*) and is attached onto the midsection of the downwardly projecting leg (41-*d*). Thus, a pivot point is formed around a partial section of the downwardly projecting leg (41-*d*) between the outwardly projecting stop member (42) and the integrally formed horizontal base (41-*b*). The partial section allows for the second end (18-*d*) of the first resilient stretchable elongated member (18-*a*) to be wrapped around thereabout and folded upon itself and fixedly attached in place by a suitable type of clip (38) or the like. Whereby, the second end (18-*d*) of the first resilient stretchable elongated member (18-*a*) can pivot or swivel around the partial section of the downwardly projecting leg (41-*d*).

Figure 6:
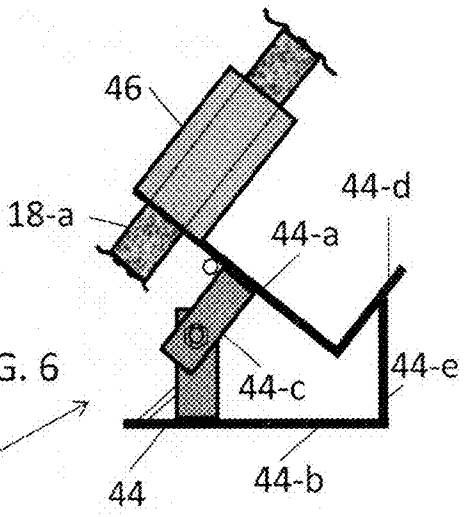
FIG. 6 is substantially a side view of the embodiment of FIG. 5 when in a closed position and not attached onto the ladder rail.
Figure 8:
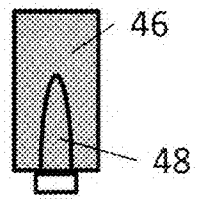
FIG. 8 is a substantially a side view depicting a stop means associated with a first attachment means.
Figure 5:
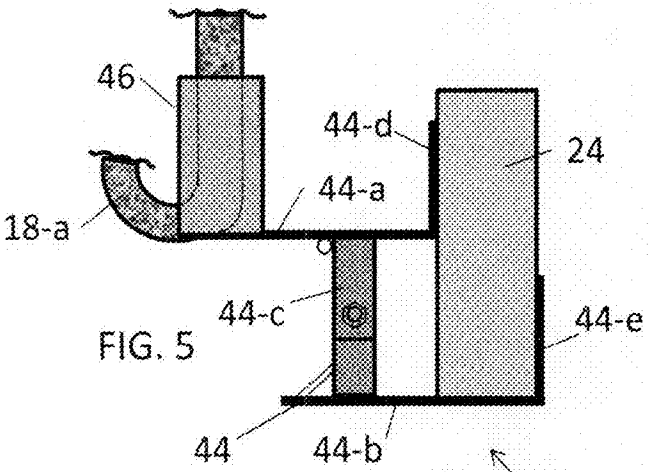
FIG. 5 is substantially a side view of a first embodiment for a first attachment means when attached onto a ladder rail when viewed from the top end of the ladder rail, respectively.

Referring now to FIGS. 5 & 6 wherein depicted is a first embodiment for the first and third attachment means (20 & 28). It is to be noted being both attachment means (20 & 28) are identical in shape and form, only the first attachment means (20) is depicted for illustrative purposes but it is to be understood there are two (20 & 28) as illustrated in FIG. 1. Each attachment means (20 & 28) are in the form of a spring loaded clamping mechanism (44). It is to be understood any suitable type of clamping mechanism of engineering choice may be utilized. Thus the clamping mechanism as described herein is only exemplary and the invention is not to be limited thereto. The spring loaded clamping mechanism (44) includes a top clamp (44-*a*) and a bottom clamp (44-*b*). Each clamp (44*a* & 44-*b*) are interconnected together by a pivot able spring actuated mechanism (44-*c*). The spring loaded clamping mechanism (44) has an open position as depicted in FIG. 5 and a closed position as depicted in FIG. 6. Each clamp (44-*a*) & (44-*b*) are not in alignment with each other. The top clamp (44-*a*) includes an upwardly protruding leg (44-*d*) and the bottom clamp includes an upwardly protruding leg (44-*e*). Each upwardly protruding leg (44-*d*) and (44-*e*) are not in alignment with each other (44-*b*) when the spring loaded clamping mechanism (44) is in the open position. Whereby, each upwardly protruding leg (44-*d*) & (44-*e*) are distanced and spaced apart from each other. Thus resulting in an open area which functions as a support receptacle which is of a size and shape to receive and support either ladder rail (24 or 32) therein when in the open position. Whereby, the spring loaded clamping mechanism (44) is removeably attached onto the ladder rail (24 or 32). Each attachment means (20 & 28) include the spring loaded clamping mechanism (44) having an upraised cylindrical hollow tube (46) thereon which functions as a stop means. The upraised cylindrical hollow tube (46) is affixed onto the top clamp (44-*a*) at an opposing end thereof and distanced and spaced apart from the upwardly protruding leg (44-*d*). Whereby, when the spring loaded clamping mechanism (44) is in the open position and attached onto the ladder rail (24 or 32) the upraised cylindrical hollow tube (46) and the ladder rail (24 or 32) are spaced apart yet in vertical alignment with each other, respectively. The upraised cylindrical tube (46) is of a shape and size to slideably receive the resilient stretchable elongated member (18-*a*) or (18-*b*) there through. The upraised cylindrical tube (46) includes an elongated partially slotted section (48) as illustrated in FIG. 8. Whereby, after the attachment means have been positioned in place, the user stretches the resilient stretchable elongated member (18-*a*) or (18-*b*) until taut eliminating any slack. Thereafter, the user can position the tautened section of the resilient stretchable elongated member within the elongated partially slotted section (48) resulting in the ladder rail (24 or 32) being stabilized against an edge of the roof structure (14). The elongated partially slotted section (48) applies tensional force upon the tautened section of the resilient stretchable elongated member until manually disengaged.

Figure 7:
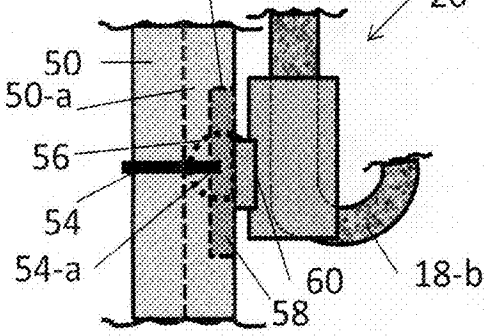
FIG. 7 is substantially a partial front side view of a ladder rail depicting a second embodiment for a first attachment means when attached thereon.

It is to be understood the present invention is substantially usable with any standard extension ladder (12) having typical ladder rails (24 & 32). However, other types of ladder construction often include a ladder rail having an additional rim on an underside thereof. Thus, herein addressed is an alternative embodiment for use with a metal or fiberglass extension ladder or the like. Therefore, referring now to FIG. 7 wherein depicted is a partial front side view of a metal or fiberglass ladder rail (50) having a downwardly facing rim (50-*a*) "shown in ghost lines". The second embodiment for the first and third attachment means (20 & 28) is most functional with the ladder rail (50) or the like. It is to be noted being both attachment means (20 & 28) are identical in shape and form, only the second embodiment for the first attachment means (20) is depicted for illustrative purposes but it is to be understood there are two (20 & 28). Each attachment means (20 & 28) are in the form of a different type of clamping mechanism (52). The clamping mechanism (52) includes an elongated member (54) which is substantially bent into a shape to attach onto the outside and top edge of the ladder rail (50). The elongated member (54) further extends downwardly from the downwardly facing rim (50-*a*) forming a downwardly extending threaded leg (54-*a*). The downwardly extending threaded leg (54-*a*) includes a threaded washer (56) and the threaded washer (56) can be thread ably adjusted up and down along the length of the downwardly extending threaded leg (54-*a*). Whereby, when the threaded washer (56) is rotated upwardly into contact with the underside of downwardly facing rim (50-*a*) the attachment means (20) is removeably affixed onto the ladder rail (50) and the downwardly facing rim (50-*a*). The downwardly extending threaded leg (54-*a*) is fixedly attached onto an attachment plate (58). The attachment plate (58) includes a swivel means (60) thereon and the swivel means (60) is fixedly attached onto the upraised cylindrical tube (46). Whereby, the upraised cylindrical tube (46) can swivel into variable positions allowing for preferred alignment when the resilient stretchable elongated member (18-*a*) or (18-*b*) is positioned and retained within the upraised cylindrical tube (46).

It can now be seen each of the different embodiments for the various attachment means are functional for stabilizing a ladder to an edge of a roof associated with a support structure. However, one of the most important advantages is the method of use for the invention which is addressed as follows: A user while standing on the pre-existing extension ladder (12) can hold onto the first ladder rail (24) or the ladder rung with one hand while simultaneously (using only their opposite hand) slideably attaching the second attachment means (30) onto the support member (26). Thereafter (still using the opposite hand) attaching the first attachment means (28) onto the second ladder rail (32). Thereafter (still using the opposite hand) grasping the first end (18-*c*) of the second resilient stretchable elongated member (18-*b*) then (still using the opposite hand) stretching the second resilient stretchable elongated member (18-*b*) until taut and eliminating any slack. Thereafter (still using the opposite hand) positioning the tautened section of the second resilient stretchable elongated member (18-*b*) within the first stop means (46) resulting in the second ladder rail (32) being stabilized against an edge of the roof structure.

Thereafter, the user while standing on the pre-existing extension ladder (12) can hold onto the second ladder rail (32) or ladder rung with one hand while simultaneously using only their opposite hand slideably attaching the fourth attachment means (22) onto the support member (26). Thereafter (still using the opposite hand) attaching the third attachment means (20) onto the first ladder rail (24). Thereafter (still using the opposite hand) grasping the first end (18-*c*) of the first resilient stretchable elongated member (18-*a*), then (still using the opposite hand) stretching the first resilient stretchable elongated (18-*a*) member until taut eliminating any slack. Thereafter (still using the opposite hand) positioning the tautened section of the first resilient stretchable elongated member (18-*a*) within the second stop means (46) resulting in the first ladder rail (24) being stabilized against an edge of said roof structure.

It is to be noted another advantage of the present invention is that both of the ladder stabilizing apparatus's may be attached onto the ladder when not in use. This is most advantageous as this eliminates the user from forgetting to carry the invention with them when climbing the ladder. The apparatus can be attached and stored on the ladder until needed for use. This is also an additional safety advantage as the user need not carry anything while climbing which is a novel feature unlike the prior art.

It can now be seen herein provided is a new ladder stabilization apparatus that is easily attached or removed using only one hand without the need for any tools. The apparatus is completely adjustable, multi-functional, of simple construction, lightweight, portable. The ladder stabilization apparatus when not in use is easily attached onto the ladder for storage until needed at a later time. The invention is useable with substantially any type of pre-existing extension ladder without any need for modification is cost effective to produce, manufacture, easily marketed and easily sold.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described the invention, what I claim as new and desire to secure by Letters Patent is:

1. A ladder stabilization apparatus comprising in combination: a first resilient stretchable elongated member; a first attachment means; and a second attachment means; said first resilient stretchable elongated member having a first end fixedly attached onto said first attachment means, said first resilient stretchable elongated member having a second end fixedly attached onto said second attachment means, said first attachment means being adjustably removeably attachable onto a first ladder rail associated with a pre-existing extension ladder, said second attachment means being removeably slideably attachable onto a support member associated with a roof structure, a second resilient stretchable elongated member, a third attachment means, a fourth attachment means, said second resilient stretchable elongated member having a first end fixedly attached onto said third attachment means, said second resilient stretchable elongated member having a second end fixedly attached onto said fourth attachment means, said third attachment means being adjustably removeably attachable onto a second ladder rail associated with said pre-existing extension ladder, said fourth attachment means being removeably slideably attachable onto said support member associated with said roof structure, said first attachment means having a first stop means and said third attachment means having a second stop means, whereby:

a user while standing on said pre-existing extension ladder can hold onto said first ladder rail or a ladder rung with one hand while simultaneously using only their opposite hand slideably attaching said second attachment means onto said support member, thereafter using said opposite hand attaching said first attachment means onto said first ladder rail, thereafter using said opposite hand grasping said first end of said first resilient stretchable elongated member, then using said opposite hand stretching said first resilient stretchable elongated member until taut eliminating any slack, thereafter using said opposite hand positioning a tautened section of said first resilient stretchable elongated member within said first stop means resulting in said first ladder rail being stabilized against an edge of said roof structure, whereby:

thereafter said user while standing on said pre-existing extension ladder can hold onto said second ladder rail or said ladder rung with one hand while simultaneously using only their opposite hand slideably attaching said fourth attachment means onto said support member, thereafter using said opposite hand attaching said third attachment means onto said first ladder rail, thereafter using said opposite hand grasping said first end of said second resilient stretchable elongated member, then using said opposite hand stretching said second resilient stretchable elongated member until taut eliminating any slack and thereafter using said opposite hand positioning a tautened section of said second resilient stretchable elongated member within said second stop means resulting in said first ladder rail being stabilized against an edge of said roof structure.

2. The ladder stabilization apparatus of claim 1 further including said second attachment means being pivot ably attached onto said second end of said first resilient stretchable elongated member and said fourth attachment means being pivot ably attached onto said second end of said second resilient stretchable elongated member.

3. The ladder stabilization apparatus of claim 1 wherein said first attachment means is in the form of a first clamping mechanism having a first upraised cylindrical tube, said first upraised cylindrical tube having an elongated partially slotted section which functions as said first stop means, and said third attachment means is in the form of a second clamping mechanism having a second upraised cylindrical tube, said second upraised cylindrical tube having an elongated partially slotted section which functions as said second stop means.

* * * * *